United States Patent [19]

Keller

[11] 4,252,490

[45] Feb. 24, 1981

[54] BALL RETRIEVING AND STORAGE DEVICE

[76] Inventor: Ernst Keller, 259 Leota Ave., Sunnyvale, Calif.

[21] Appl. No.: 927,098

[22] Filed: Jul. 24, 1978

[51] Int. Cl.[3] ..... B60P 1/00

[52] U.S. Cl. ..... 414/434; 56/328 R

[58] Field of Search ..... 414/434, 435, 436, 437, 414/438, 439, 440; 56/328 R

[56] References Cited

U.S. PATENT DOCUMENTS

| | | | |
|---|---|---|---|
| 3,485,398 | 12/1969 | Offner | 414/440 |
| 3,902,749 | 9/1975 | Falitz | 414/440 |
| 4,077,533 | 3/1978 | Meyer | 414/440 |

*Primary Examiner*—Lawrence J. Oresky
*Attorney, Agent, or Firm*—Claude A. S. Hamrick

[57] ABSTRACT

A ball retrieving and storage device for gathering balls lying upon a court floor or other flat surface and including a wheeled box-like collector having a bar extending across the front of the collector, the bar having a ball engaging surface which is normally carried above the floor at a height slightly less than the diameter of the balls to be collected so that when the device is moved over the floor and the bar contacts a ball, the bar is caused to ride across the top of the ball and trap it within the collector.

14 Claims, 6 Drawing Figures

BALL RETRIEVING AND STORAGE DEVICE

BACKGROUND OF THE INVENTION

1. Field of the Invention

This invention relates generally to ball retrievers and more particularly to an improved manually-operated, wheeled device for collecting and storing balls.

2. Description of the Prior Art

A ball of some type or another is used as the principal object of virtually every team or multiple player sports game currently being played. Good examples of this include football, baseball, basketball, golf and tennis.

When two or more players are actually playing one of the above-mentioned games, it is the usual case that very few balls are needed. For instance, in tennis it is customary to play with one can of three tennis balls. However, when a player wishes to practice a game on his own, a great many balls are often employed. For example, golfers go to driving ranges and hit full buckets of golf balls and tennis players go to tennis courts to practice their serves with a basketful of balls.

Also, professional instructors often employ a great number of balls when teaching their sport. In tennis, it is common for an instructor to take ball after ball out of a basket and toss them to one or more of his students so that they may practice a particular stroke under his supervision.

A nuisance created by using a number of balls to practice is that eventually someone has to go to the trouble of picking them up. This can be a long and tiresome job, particularly after a hard, athletic workout. Furthermore, for a professional instructor, the time spent gathering balls is a waste of money as well as time because he could be using that same time to instruct other students.

In recognition of this need for a means for rapidly retrieving and storing balls, a number of prior art devices have been developed. For example, in the U.S. Pat. No. 3,593,868 to G. Folz, a device is disclosed which includes a brush element that sweeps balls gathered by a cooperating pair of scoop members into a receiving basket. A number of other special purpose members are also included in Folz's device to perform such functions as dislodging balls from corners or from against wall surfaces.

Folz's tennis ball retriever is a relatively mechanically complex device and has many moving and rotating parts to wear, malfunction and work out of adjustment. At the other extreme, the device disclosed in the U.S. Pat. No. 3,371,950 to K. Stap is a simple, basket-like ball container including a plurality of rods forming the container's base, the rods being disposed in parallel and separated by a distance slightly less than the diameter of a tennis ball. When the base of the basket is pushed onto a tennis ball, the ball is forced through adjacent rods of the base into the container where they are retained for future use. While Stap's invention is mechanically quite simple, it does not pick up tennis balls anywhere near as fast as Folz's device.

In summary, the prior art discloses at one extreme a device which is capable of quickly picking up balls but which is mechanically complex and, at the other extreme, a device which is mechanically simple but picks up balls relatively slowly. The problem that the prior art has not solved, then, is how to produce a mechanically simple ball collecting and storing device which also collects balls efficiently and rapidly.

Applicant also wishes to make of record the following patents which disclose prior art ball retrieving storage devices, none of which address the above-stated problem: U.S. Pat. No. 3,926,465 of A. Hoherland, et al.; U.S. Pat. No. 3,902,749 of L. Falitz; U.S. Pat. No. 3,485,398 of M. Offner; and U.S. Pat. No. 3,889,996 of T. Campbell.

SUMMARY OF THE PRESENT INVENTION

It is therefor an object of this invention to provide a mechanically simple device for collecting and storing balls rapidly and efficiently.

Another object of this invention is to provide a device which can collect balls in difficult-to-reach places, such as along fences or at the net line, in a quick and efficient manner.

Briefly, a ball retriever in accordance with the present invention includes a body forming a ball receiving container having an opening extending across the lower front edge thereof, a set of wheels for supporting the container over the court floor or other planar surface from which the balls are to be collected, and a ball trapping member which extends across the front of the collector in front of the opening and is normally separated from the planar surface by a distance slightly less than the diameter of the balls to be collected so that when the device is moved over the planar surface and the trapping member contacts a ball, it rides across the top of the ball and allows the ball to pass through the opening and into the container.

An advantage of the present invention is that it effectively captures the balls irregardless of the speed at which it is propelled, as contrasted with some prior art devices which operate best at one particular speed. In other words, the device may be moved across the planar surface either slowly or at a rapid rate and will capture balls with equal facility at either extreme.

Another advantage of the present invention is that very few moving parts are necessary to the functioning of the device. In fact, with the exception of the wheels supporting the collector, none of the parts move relative one another when my device is in its ball collection mode. Obviously, this reduces the number of parts subject to wear, malfunction and maladjustment and reduces the overall cost of the device.

These and other objects and advantages of the present invention will no doubt become apparent to those skilled in the art after having read the following detailed description of the preferred embodiment illustrated in the several figures of the drawing.

IN THE DRAWING

DETAILED DESCRIPTION OF THE PREFERRED EMBODIMENT

Figure 1:
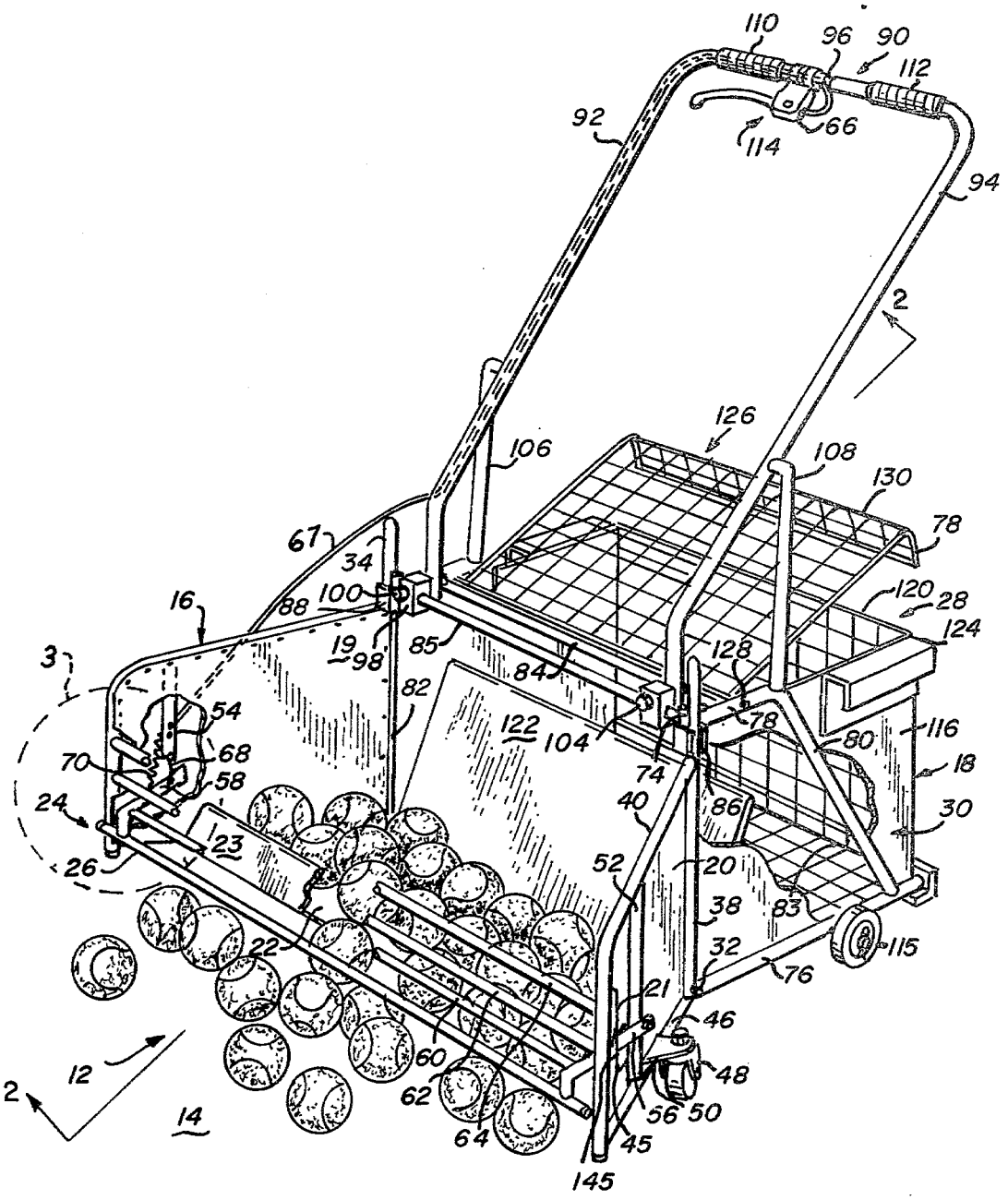
FIG. 1 is a partially broken perspective view of a ball collecting and storage device in accordance with the present invention.

Referring to FIG. 1, a device 10 for collecting and storing balls 12 that are lying on a court floor or other substantially flat surface 14 is shown. In this preferred embodiment, the body portion of the illustrated device may be functionally divided into a front section 16 which forms a ball receiving compartment that is operative to capture tennis balls, and a rear section 18 which forms a storage compartment that is able to store the tennis balls collected by the front section.

Front section 16 includes a right side wall 19, a left side wall 20, a tennis ball supporting bottom 22 connecting the lower edges of side walls 19 and 20, and a ball trapping mechanism 24 extending across the front of the section and between the side walls, and being rotatable between a retrieving position and a trapping position.

The front edge of bottom 22 has a rearwardly bent lip that forms a fence 23 for holding balls within the collector section. The lip is generally taller than a single ball. Rear section 18 includes a basket 28 which is supported by a framework 30. Front section 16 and rear section 18 are connected together by a pivot pin 32 on the lower left side of the device and a similarly located pivot pin which is on the other side of the device but which cannot be seen in this figure. These pivots allow the front section to be folded over the rear section when the device is not in use, as will hereinafter be discussed in greater detail with reference to FIG. 4.

Front section 16 is an assemblage of sheet metal and tubular parts which are preferably attached together by welding. The sidewall 20 has a rearward edge attached to a tubular post 38, a lower edge attached to a tubular member 46 and a forward and top edge attached to an L-shaped tubular member 40.

Similarly, sidewall 19 has a rear edge connected to a post 34, a lower edge attached to a post not clearly seen in this figure, and a front and upper edge attached to an L-shaped member 36. Members 36 and 40 have an outside radius of curvature between their two legs that is sufficiently great to prevent their catching on the mesh of a tennis net when the device is pushed along the net. The front edges of sidewalls 19 and 20 are held in position by a pair of rods 62 and 64 the ends of which are secured to members 36 and 40. In addition, the sheet metal bottom 22 extends between the sidewalls and between the sloped front fence 23 and the back edge of the front section.

A castor wheel 48 is attached to member 46 by a connecting bracket 50. A similar castor wheel is attached to the corresponding member of sidewall 19. Thus, the front section of my device is supported by a pair of castor wheels which carry it in slightly raised disposition above the surface 14.

Attached to and rising upwardly from member 46 is a post 52, and attached to and rising upwardly from the corresponding reinforcement member on wall 19 is a post 54. Pivotally attached to post 52 is an L-shaped bar 56 which is a part of the ball trapping mechanism 24, and pivotally attached to post 54 is a second L-shaped bar 58 which likewise is a part of ball trapping mechanism 24. The ends of bars 56 and 58 are attached together by a trapping bar 26 and a strengthening rod 60.

The ball trapping mechanism 24 is caused to rotate about its pivotal attachments by means of a push/pull cable 66 which is comprised of a sheathing 67 encasing a wire 68. The sheathing 67 is attached to post 54 and the wire 68 is attached to a rear end portion of bar 58. When the wire is retracted into the sheathing, the ball trapping member is caused to rotate downwardly to prevent any balls trapped therebetween from passing back under member 26 if the device is pulled rearwardly. A return spring 70 has one end attached to post 54 and its other end attached to bar 58 so as to normally bias the ball trapping mechanism 24 into its retrieving position illustrated in FIG. 1.

Frame 30 of the rear section of the device is comprised of an upright side port 74, a basket supporting side member 76, an upper member 78 and a connecting member 80. A similar trapezoidially-shaped assembly of which only a post 82, corresponding to post 74, can be seen in this figure, forms the other side of the frame. The two side assemblies are connected by cross bars 83, 84 and 85. Rear support wheels 115 are attached to the side members 76.

Posts 74 and 82 are provided with retaining clips 86 and 88, respectively, into which the upper portions of posts 38 and 34 are snapped to prevent the mutual rotation of the front and rear sections around their pivotal attachment points 32. As will be discussed below, posts 38 and 34 of the front section can be disengaged from the retaining clips 86 and 88, respectively, so as to permit the front section to be folded back around the rear section.

Attached to frame 30 is a handle bar assembly 90 comprising an L-shaped rightside member 92, an L-shaped leftside member 94, and a connector 96 for attaching the distal ends of the two side members together. The lower ends of members 92 and 94 are attached to pivot blocks 98 and 102 by pivot pins 100 and 104, respectively. Blocks 98 and 102 are freely rotatable around connecting bar 85 so that the handle bar assembly 90 can also rotate relative thereto. The handle bar assembly 90 is held in an angularly elevated position by a pair of stop members 106 and 108 which are rigidly attached to members 92 and 94, respectively, and extend downwardly to contact the upper portions of the frame 30.

Handle bar assembly 90 includes handgrips 110 and 112 which can be grasped and pushed upon to propel the device forwardly and pulled upon to propel the device rearwardly. A cable actuator lever 114 is provided so that a person who is operating the device can actuate the trapping mechanism 24.

In this embodiment basket 28 is open-topped and has sheet metal sidewalls 116 and 118, a wire mesh rear wall 120, and a wire mesh base (not seen in this figure). The base of the basket is supported by a plurality of support brackets not seen in this figure. The basket also has a sheet metal front wall 122 that slopes inwardly and has a height lower than the remainder of the basket's walls by an amount slightly greater than the diameter of a tennis ball. The basket is provided with handles 124 attached to the sidewalls. Basket 28 is completely removable from frame 30 to facilitate tennis ball usage, separate storage, or dumping into another receptacle such as that of a tennis ball pitching machine.

Also shown in FIG. 1 is a wire mesh cover 126 having its forward edge pivotally connected to frame 30, and a rearward edge 130, which is bent downwardly to hook onto an upper section of the rear wall 120 of the basket. Cover 126 can be swung up to facilitate the removal of basket 28, or can be swung down to close the basket.

Figure 2:
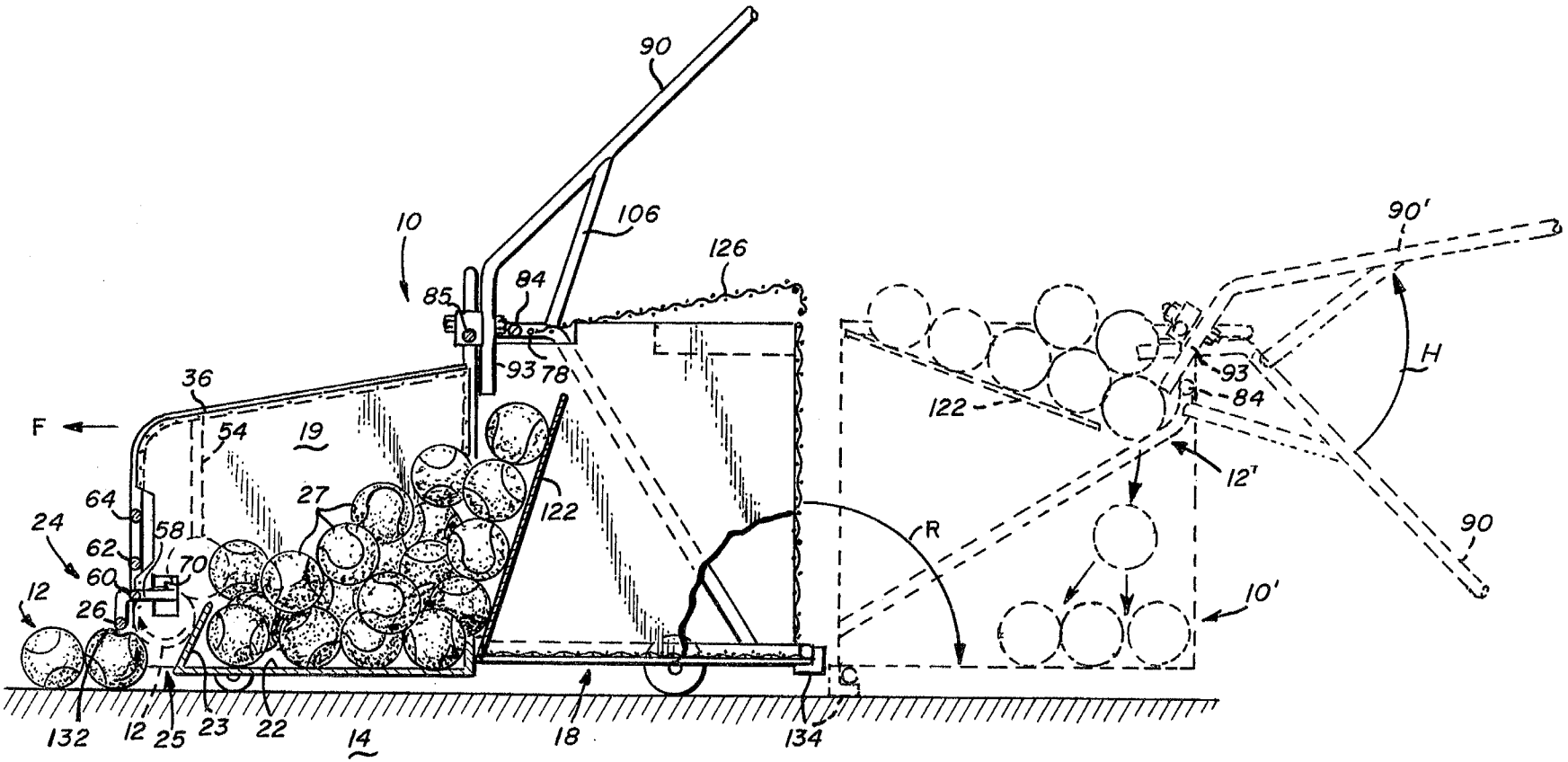
FIG. 2 is a cross sectional view taken along line 2—2 of FIG. 1.

Referring now to the cross-sectional view shown in FIG. 2, the way in which tennis balls are collected and stored by this device can be described. Spring 70 normally holds bar 58 against bar 62 so that the trapping mechanism 24 is in the retrieving position with the bar 26 defining a ball depressing surface 132 that is separated from surface 14 by slightly less than the diameter of one of the tennis balls 12. In the preferred embodiment, surface 132 is positioned above surface 14 approximately one eighth to one quarter of an inch less than the diameter of an average tennis ball.

When the device is pushed forwardly, in the direction of arrow F, ball engaging surface 132 contacts the balls 12 and rides thereover. This action also causes the ball to rotate as it passes under the trapping member and into the section 25 of the device lying between bar 26 and fence 23.

As balls fill section 25, additional balls passing under bar 26 will engage the balls in section 25 and cause them to roll up and over the fence 23 and into the collector section 27. When a large number of balls have been collected in section 27 the user will stop pushing on the handle bar assembly and rotate the entire device rearwardly, as indicated by the arrow R, by engaging the snubbers 134 attached to the back corners of frame 30 with the surface 14 and then further pulling upon the handle bar until the device is positioned as shown at 10'. As the device is rotated into the position 10' the balls 12' will roll down wall 122 and into the basket. Note that as the device is rotated backwardly the handle bars 90 rotate forwardly relative to their normal position and into the position 90' as indicated by the arrow H. Note also that as handle bars 90 rotate into the position 90' the ends 93 thereof engage bar 84 and limit the rotation. This makes it easier to rotate the device back onto the operating position.

After the balls have rolled into the basket, the device is returned to the upright position by lifting on the handle bar and rotating the device in the forward direction about the snubbers 134.

Figure 3:
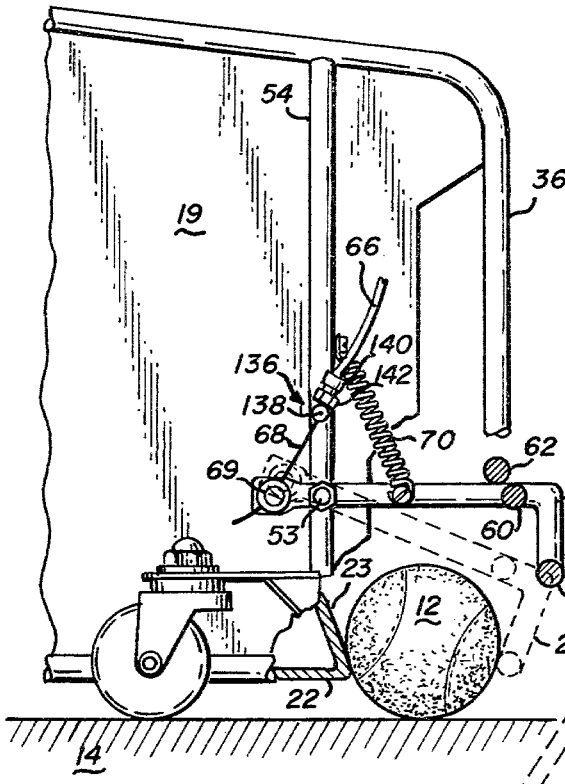
FIG. 3 is a partially broken side elevational detail of the part of FIG. 1 encircled by the dashed line 3.

Referring now to FIG. 3, which is a detailed view of the portion of FIG. 1 encircled by the dashed line 3, the operation of ball trapping mechanism 24 may be discussed in greater detail. As indicated above, spring 70 normally biases the mechanism into the retrieving position as shown in solid lines so that surface 132 is spaced from the floor surface 14 slightly less than the diameter of a tennis ball, as previously discussed. When cable actuator 114 on handle bar 90 is squeezed by a user, wire 68 is retracted into the sheathing of the cable to rotate assembly 24 into the trapping position as shown at 24'. In this position balls 12' are securely trapped inside the section 25 of the device so that when the device is backed up or rotated about the snubbers, and balls will not fall out of the space between trapping member 26 and the forward edge of platform 22.

The sheathing of cable 66 is attached to post 54 by an adjustable attachment assembly 136 including a stub extending outwardly from post 54, an adjustment nut 140 for adjusting the length of the wire 68 protruding from the end of the cable, and a lock nut 142. Referring additionally now to FIG. 1, note that bar 58 extends through an aperture 143 in wall 19 and that bar 56 extends through an aperture 145. These apertures are provided so that bars 56 and 58 remain parallel to the longitudinal axis of the device as mechanism 24 rotates about the pivots 53.

Figure 4:
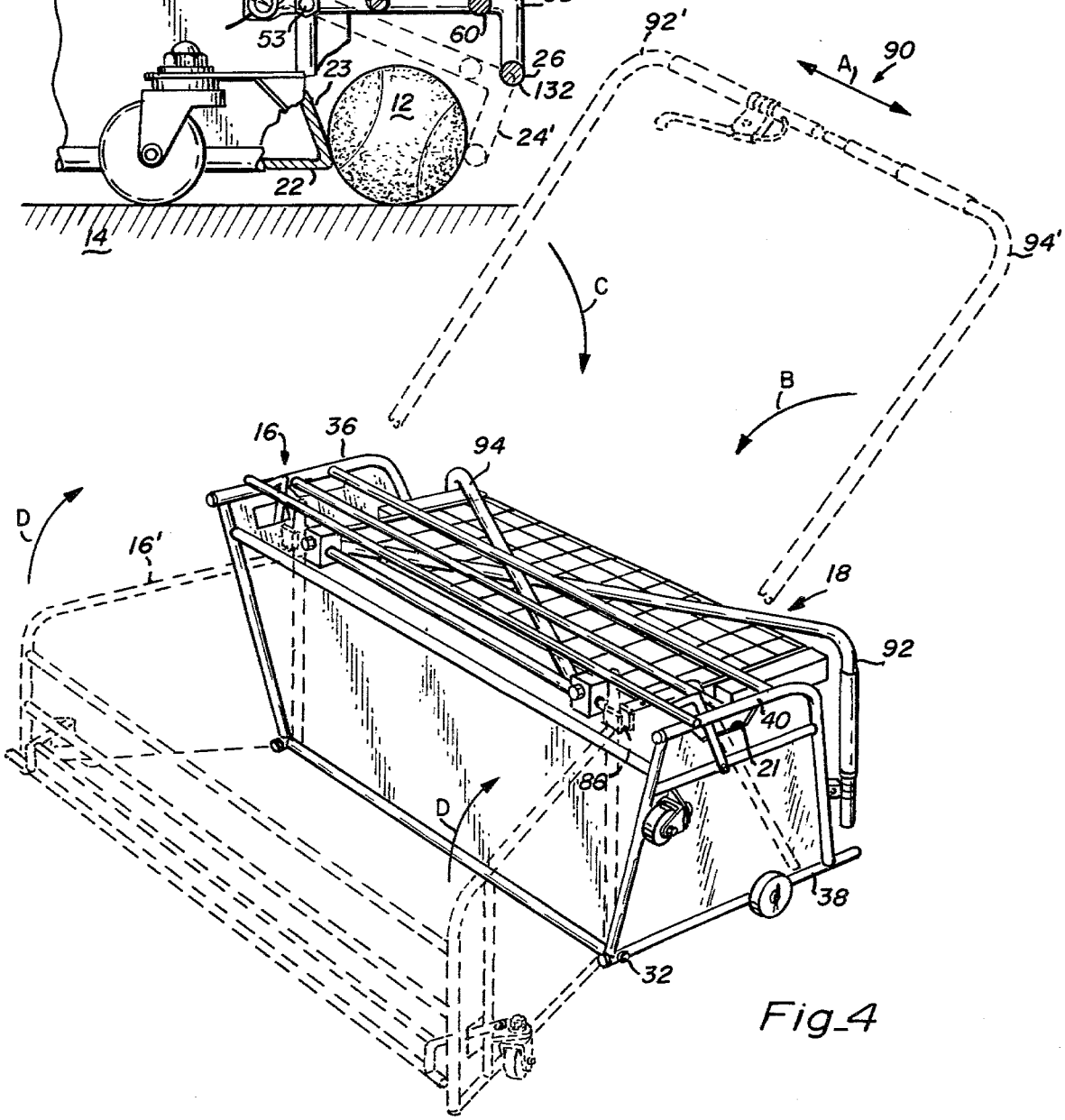
FIG. 4 is a perspective view of the ball collecting and storage device shown in FIG. 1 with the front section folded for storage and transport.

The method of folding the preferred embodiment of the device into a compact package is shown in FIG. 4. First, the handle bar assembly is pulled apart as shown by the arrow A. The left handle bar 94 is then pivoted rightwardly and downwardly in the direction of arrow B to the position shown and right handle bar 92 is pivoted leftwardly and downwardly in the direction of arrow C to the position shown.

Posts 38 and 34 of the front section are then pulled outwardly until they are free of the clips 86 and 88, respectively, and the forward section 16 is pivoted upwardly and about the pivot 32 as shown by arrows D and into position adjacent the front wall of the basket. When folded in this way, the device is extremely portable and storable. It may be conveniently lifted inserting the fingers into the openings 21 in the sidewalls and grasping the members 36 and 40.

Figure 5:
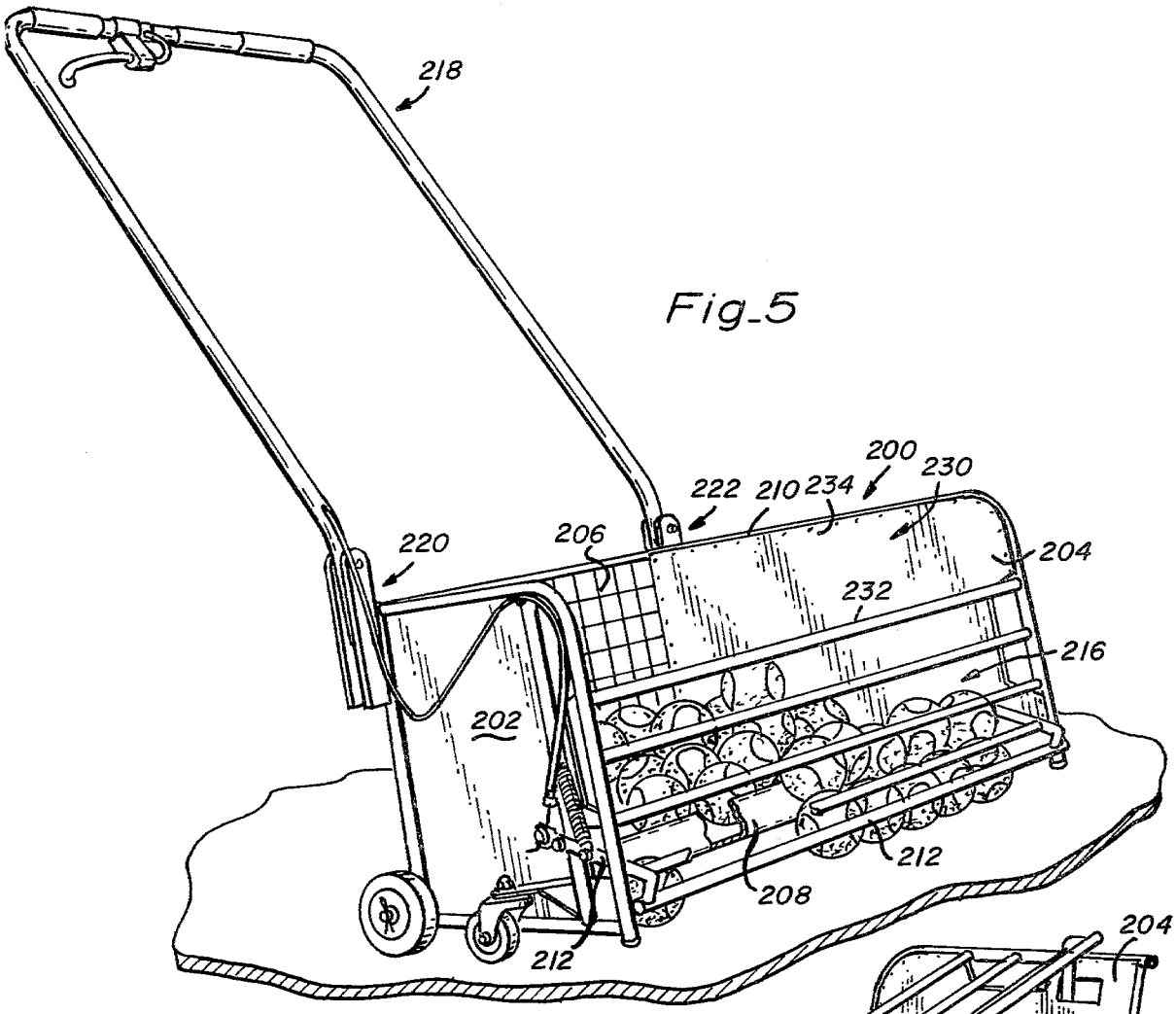
FIG. 5 is a partially broken perspective view of an alternate embodiment of a ball collecting and storage device in accordance with the present invention.
Figure 6:
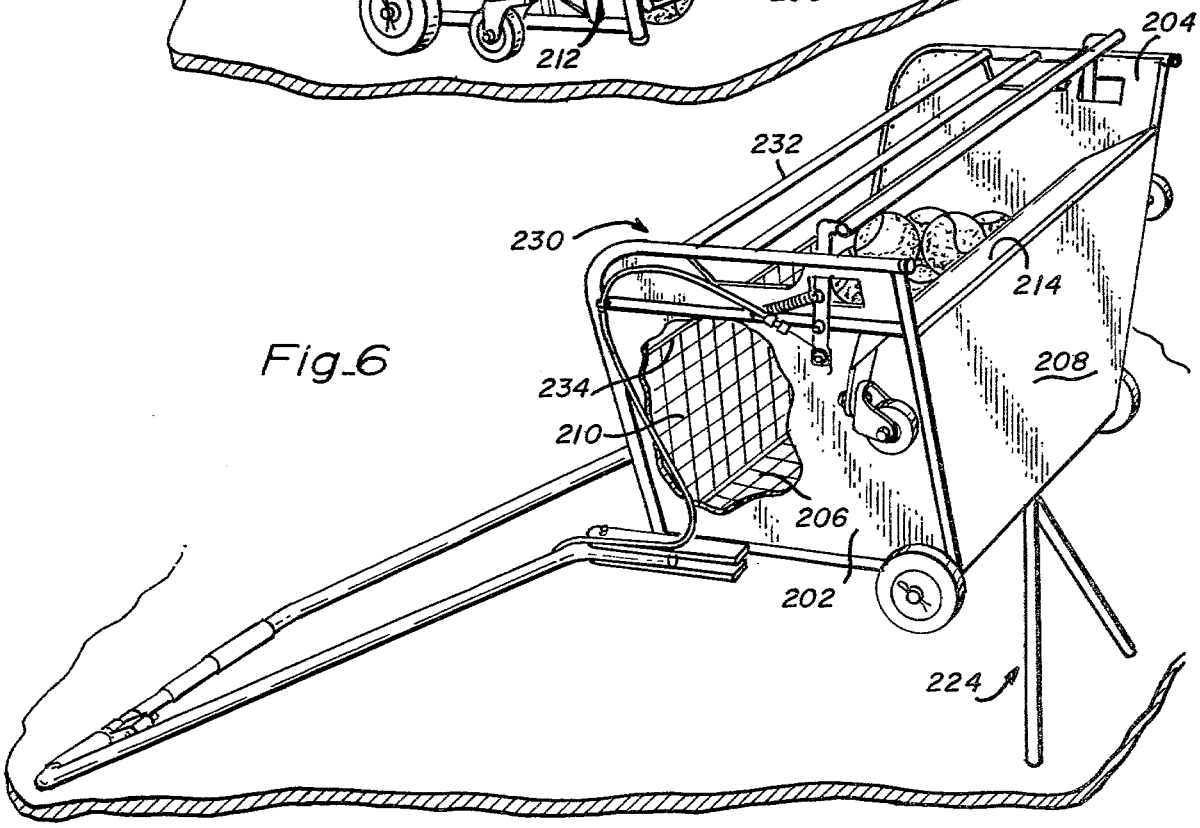
FIG. 6 is a partially broken perspective view of the device shown in FIG. 5 disposed in a position which allows for easy ball access and removal by a player.

In FIGS. 5 and 6, an alternate embodiment of the present invention is shown at 200. This embodiment is basically a simplified version of the previously described embodiment in that the collector section and the rear storage section is combined into one unit. This alternate embodiment does not collect or store as many balls as that of the preferred embodiment but it is quite adequate for the needs of an individual tennis player.

Embodiment 200 comprises a box-like structure having sidewalls 202 and 204, a wire mesh rear wall 206, a bottom 208 having a front fence 214, and a partially covered mesh top portion 210. As in the previously described embodiment, sidewalls 202 and 204 diverge to form a forwardly opening scoop for maximum ball retrieval and a trapping mechanism 212 is provided which works in substantially the same manner as does the trapping mechanism of the preferred embodiment. In this embodiment, all four wheels, including two caster wheels in the front and two standard wheels in the rear, are attached to lower portions of the sidewalls. The handle bar assembly 218 is similar to the handle bar assembly of the preferred embodiment but its attachment to the rest of the device is accomplished by means of a pair of pivots connecting it to a pair of elongated brackets 220 and 222, the pivot axis of which are skewed relative to each other. When the two halves of the handle bar mechanism are separated, they can be rotated forwardly and downwardly over the box-like structure.

As shown in FIG. 6, the device is also provided with a pair of fold-out legs 224 which are attached to the back walls and cooperate with the handle bar assembly to form a stand for the device. When tilted back as shown, tennis balls collected by the device can be easily withdrawn by a player by simply reaching into the opening 230 between the front bar 232 and the front edge 234 of the top 210.

The method of using this device includes pushing it across a surface on which tennis balls are lying and collecting a number of balls. When the device is backed up, the cable actuator is grasped by the user to lower the trapping mechanism, as described previously, so that no balls are lost. Similarly, when the device is tilted backwards for access to the balls, the cable actuator is grasped to lower the trapping mechanism, again to prevent the loss of balls remaining between the fence 214 and the trapping mechanism 212.

While this invention has been described in terms of a preferred embodiment and an alternate embodiment, it is contemplated that certain modifications and alterations thereof will become obvious to one skilled in the art.

For instance, it has been assumed in the preceding description that the devices were mostly constructed from sheet metal and metal tubes. It is also quite possible to construct the devices from molded plastic of fiberglass. Furthermore, the wheels of the device may be motorized to produce a power driven device. It is therefore intended that the following appended claims be interpreted as covering all such modifications and alterations as fall within the true spirit and scope of this invention.

What is claimed is:

1. A device for retrieving and storing balls lying upon a court floor or the like comprising:

body means forming a ball receiving compartment and including an opening extending across a front portion thereof for receiving balls retrieved;

roller means supporting said body means such that it may be freely moved over the court floor in the direction of said opening; and ball trapping means affixed to said body means and including an elongate trapping member extending across said front portion, said trapping member having a non-rotating ball engaging surface normally carried in a ball trapping position above the court floor at a height which is slightly less than the diameter of the balls to be retrieved, such that when said device is moved toward balls to be retrieved the balls are contacted by said ball engaging surface and are caused to rotate in the direction of movement of said device as said trapping member rides thereacross, the balls thereby being caused to enter said compartment through said opening.

2. A device for retrieving and storing balls as recited in claim 1 wherein said ball receiving compartment is formed by a pair of upstanding sidewalls, a rearwall, a bottom and means at least partially closing the front thereof, said opening being formed between said means partially closing the front thereof and said bottom.

3. A device for retrieving and storing balls as recited in claim 2 and further comprising support means attached to said rear wall and pivotable into a position extending away from said rear wall such that said body means can be rotated 90° rearwardly and be supported by said support means in a position raised on the court floor.

4. A device for retrieving and storing balls as recited in claim 3 and further comprising handle means affixed to said body means and extending upwardly and rearwardly relative thereto, said handle means cooperating with said support means to support said body means in the raised position when said body means is rotated 90° rearwardly.

5. A device for retrieving and storing balls as recited in claim 2 and further comprising support means attached to said body means and pivotable into a position extending away from said rear wall such that said body means can be rotated rearwardly into a position wherein it is at least partially supported by said support means in a position raised above the court floor.

6. A device for retrieving and storing balls as recited in claim 5 and further comprising handle means affixed to said body means and extending upwardly and rearwardly relative thereto, said handle means cooperating with said support means to support said body means in the raised position when said body means is rotated rearwardly.

7. A device for retrieving and storing balls as recited in claim 2 wherein the front edge of said bottom is disposed rearwardly of said ball engaging surface.

8. A device for retrieving and storing balls as recited in claim 7 and further comprising retainer means disposed rearwardly of said ball engaging surface for receiving the balls in a position rearwardly of said ball engaging surface after they have passed thereunder.

9. A device for retrieving and storing balls as recited in claim 1, 2, 7 or 8 wherein said trapping member is movably secured to said body means and is movable between a retrieving position in which said ball engaging surface is disposed as previously described and a trapping position in which said trapping member is rotated into a closing position which prevents balls from passing back through said opening.

10. A device for retrieving and storing balls as recited in claim 9 and further comprising detachable handle means affixed to said body means and extending upwardly and rearwardly relative thereto.

11. A device for retrieving and storing balls as recited in claim 2 wherein the front edge of said bottom is turned upwardly to form a fence over which retrieving balls pass after having entered said opening.

12. A device for retrieving and storing balls as recited in claim 1, 2 or 11 wherein said trapping member is movably secured to said body means and is movable between a retrieving position in which said ball engaging surface is disposed as previously described and a trapping position in which said trapping member is rotated downwardly so as to close said opening.

13. A device for retrieving and storing balls as recited in claim 12 and further comprising handle means connected to said body means and extending upwardly and rearwardly relative thereto and including control means coupled to said trapping member so as to enable one gripping said handle means to rotate said trapping member from said retrieving position into said trapping position.

14. A device for retrieving and storing balls as recited in claim 12 and further comprising handle means connected to said body means and extending upwardly and rearwardly relative thereto, and means permitting said trapping member to be selectively positioned in either said retrieving position or said trapping position.

* * * * *